US007862379B2

(12) United States Patent
Annecke

(10) Patent No.: US 7,862,379 B2
(45) Date of Patent: Jan. 4, 2011

(54) SHIELDED ELECTRICAL CONNECTION ARRANGEMENT

(75) Inventor: Alfred Annecke, Heilbronn (DE)

(73) Assignee: Amphenol Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 12/469,946

(22) Filed: May 21, 2009

(65) Prior Publication Data

US 2009/0305562 A1 Dec. 10, 2009

(30) Foreign Application Priority Data

Jun. 4, 2008 (DE) ..... 10 2008 026 771

(51) Int. Cl.
*H01R 9/03* (2006.01)

(52) U.S. Cl. ..... 439/607.58

(58) Field of Classification Search ..... 439/358, 439/581, 943, 752, 541.5, 607.58
See application file for complete search history.

(56) References Cited

U.S. PATENT DOCUMENTS

| | | | | |
|---|---|---|---|---|
| 4,786,257 | A | 11/1988 | Tengler | |
| 5,743,765 | A * | 4/1998 | Andrews et al. | 439/607.1 |
| 5,803,769 | A | 9/1998 | Belopolsky | |
| 6,093,046 | A | 7/2000 | Chiou et al. | |
| 6,123,570 | A | 9/2000 | Hwang | |
| 6,312,268 | B1 | 11/2001 | Chih-Kai | |
| 6,692,262 | B1 * | 2/2004 | Loveless | 439/63 |
| 7,175,447 | B2 * | 2/2007 | Pan | 439/79 |
| 2001/0004555 | A1 * | 6/2001 | Harting et al. | 439/63 |
| 2005/0191904 | A1 | 9/2005 | Fukushima et al. | |

FOREIGN PATENT DOCUMENTS

| | | |
|---|---|---|
| DE | 344397 | 11/1921 |
| EP | 0 682 387 A1 | 11/1995 |
| EP | 0 969 566 A1 | 1/2000 |
| FR | 2 691 585 A1 | 11/1993 |
| GB | 2 257 851 A | 1/1993 |

* cited by examiner

*Primary Examiner*—Jean F Duverne
(74) *Attorney, Agent, or Firm*—Blank Rome LLP

(57) ABSTRACT

This invention relates to a shielded electrical connection arrangement with a plug-in contour which accommodates at least one plug-in contact with a plug-in region and a receiving region for receiving and holding the plug-in contact in an attachment section of the plug-in contact, a cover for attaching the attachment section in the receiving region of the plug-in contour, the cover and the receiving region having shields on their outside contour and electrically conductive connecting elements being provided for contact-making of the plug-in connections and mechanical connection of the cover to the plug-in contour.

9 Claims, 2 Drawing Sheets

SHIELDED ELECTRICAL CONNECTION ARRANGEMENT

CROSS-REFERENCE TO RELATED APPLICATIONS

This application claims priority to German Application No. 10 2008 026 771.6 filed Jun. 4, 2008, the entire disclosures of which are incorporated by reference herein.

This invention relates to a shielded electrical connection arrangement with a plug-in contour which accommodates at least one plug-in contact with a plug-in region and a receiving region for receiving and holding the plug-in contact in an attachment section of the plug-in contact, and a cover for attaching the attachment section in the receiving region of the plug-in contour, the cover and the receiving region having shields on their outside contour and electrically conductive connecting elements being provided for contact-making of the plug-in connections and mechanical connection of the cover to the plug-in contour.

Furthermore the invention relates to a process for producing a shielded electrical connection arrangement as claimed in one of the preceding claims and with the following steps:

accommodation of the attachment section of the plug-in contact between the cover and the receiving region, mechanical attachment of the cover and attachment section and contact-making of the shields by electrically conductive connecting elements.

Especially in the electrical contact-making of fault-susceptible devices such as hybrid drives or electrical drives in motor vehicles there are generally fail-safe versions. One important fault factor for controlling the drives is seen in the incident radiation of electrical interference fields. On the other hand the emission of interference fields from these power connections into the control electronics should also be avoided. In this respect, in automotive engineering there are extremely high demands on electrical shielding and on sealing of contact-making and connection arrangements against incident and radiating interference. Mechanical sealing of these connection arrangements against ambient effects such as humidity is also of great importance.

In the prior art special metal coatings or screen sheets are known which shield plug-in connections against the aforementioned interference influences or prevent electromagnetic interference emissions from emerging from the connection arrangement. The disadvantage in these arrangements is the high mechanical effort in assembly or the application of the corresponding protective layers, especially when these housing arrangements are to be made in one part. Generally the requirements and application-specific installation situations are such that a corresponding connection arrangement must be made as a plug-in connection. They are generally composed of a plurality of parts (housing parts and contacts) which must be safely mounted, for example by catch connections. To the extent shielding is required in addition, it should be attached at least to all outside housing parts such that the shielding is tight; this is problematic especially for several assembled housing parts. At junction sites at which the EMC shielding surface must be transferred from one housing part to another housing part, there is on the one hand the problem of mechanical and electrical connection and on the other hand the problem of ensuring good electromagnetic tightness.

Furthermore it should be watched that of the plug-in connectors, the contacts which are to be connected are provided with connecting leads. Since the electrical connection arrangements are very small components, production-engineering tolerances play a major part, especially when so-called EMC gaps form.

Therefore the object of the invention it to propose a shielded electrical connection arrangement which on the one hand calls for high electrical shielding and on the other hand mechanical and electrical connection of the individual parts of the connection arrangement among one another which is as optimum as possible, especially on EMC problem zones.

This object is achieved with the features of claims 1 and 9. Advantageous developments of the invention are given in the dependent claims. The framework of the invention also includes all combinations of at least two features which are given in the specification, the claims and/or the drawings.

The invention is based on the idea of providing shields on the cover and attachment section of a plug-in contour which accommodates at least one plug-in contact such that there are electrically conductive connection elements for contact-making of the shields and at the same time for mechanical connection of the cover to the plug-in contour. The double function of the electrically conductive connection elements provides an electrical connection arrangement which is on the one hand very simple, but on the other very effective, with shielding which at the same time can be mechanically sealed very effectively. Advantageously the electrically conductive connecting elements can be made without catch connections in order to obtain a permanent connection quality, a positive connection being advantageous, preferably one which cannot be released without destruction.

In one advantageous configuration of the invention the shields are formed at least partially from an electrically conductive coating which can be applied especially easily and in an especially blanketing manner.

In another advantageous configuration of the invention the connecting element are rivets, preferably solid metal rivets. Rivets can produce a defined mechanical connecting force and at the same time contact can be made with the shielding which is preferably provided as a coating by the rivet heads and the mating rivet piece of the rivets being pressed onto the shielding. Especially under the continuous vibration conditions which prevail in motor vehicles are solid metal rivets which can be easily checked for connection quality advantageous.

In this respect it is especially advantageous if the connecting elements are countersunk into the outside contour of the cover and receiving region, preferably such that they end essentially flush with the outside contour. This measure prevents antenna action and/or stress peaks on the outside contour. Furthermore the aforementioned measure facilitates coating of the connection arrangement and saves material.

Advantageously the receiving region has a peripheral shoulder in which the connecting elements are located. The peripheral shoulder of the receiving region corresponds to the cover and both components are penetrated by rivet holes which are accordingly flush with one another after the cover has been seated on the receiving region of the plug-in contour. For this purpose there are preferably orientation ribs to prevent incorrect assembly and to facilitate installation.

Installation is further facilitated by the peripheral shoulder being located transversely to the plug-in direction S.

In order to protect the connecting arrangement and especially the shielding, the connection arrangement has an insulating coating which can at the same time form part of the plug-in contour.

To the extent a shielding connection is joined to the shielding and is preferably attached by the connecting elements and/or contact is made by them, the shielding action can be distinctly improved.

Other advantages, features and details of the invention will become apparent from the description of preferred embodiments and using the drawings.

FIG. 1 shows an electrical connection arrangement without coating 1, the coating 1 being shown in FIG. 3.

Figure 1:
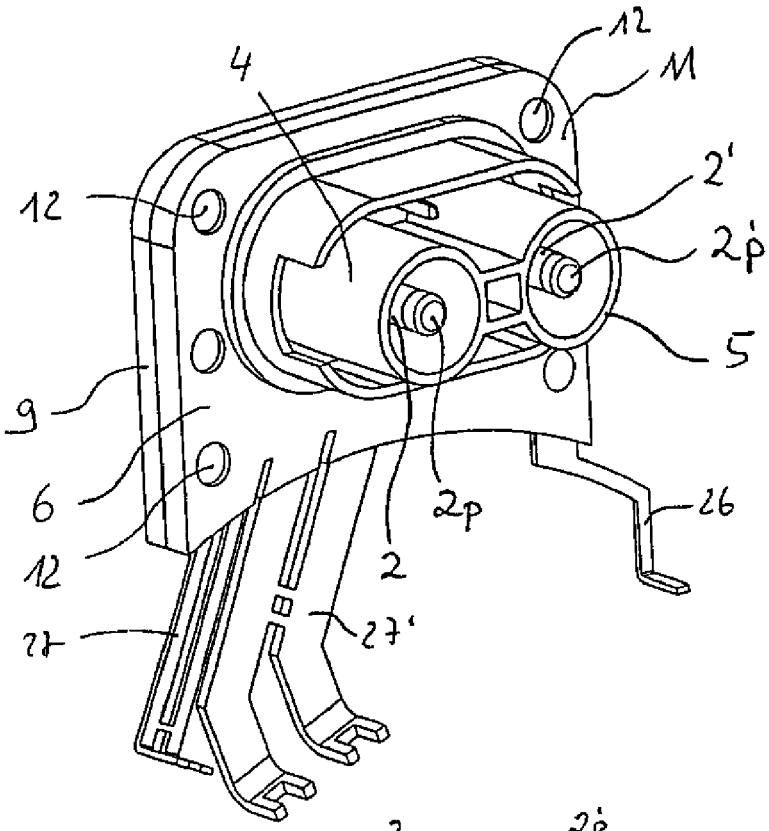
FIG. 1 shows a perspective view of the electrical connection arrangement as claimed in the invention.
Figure 2:
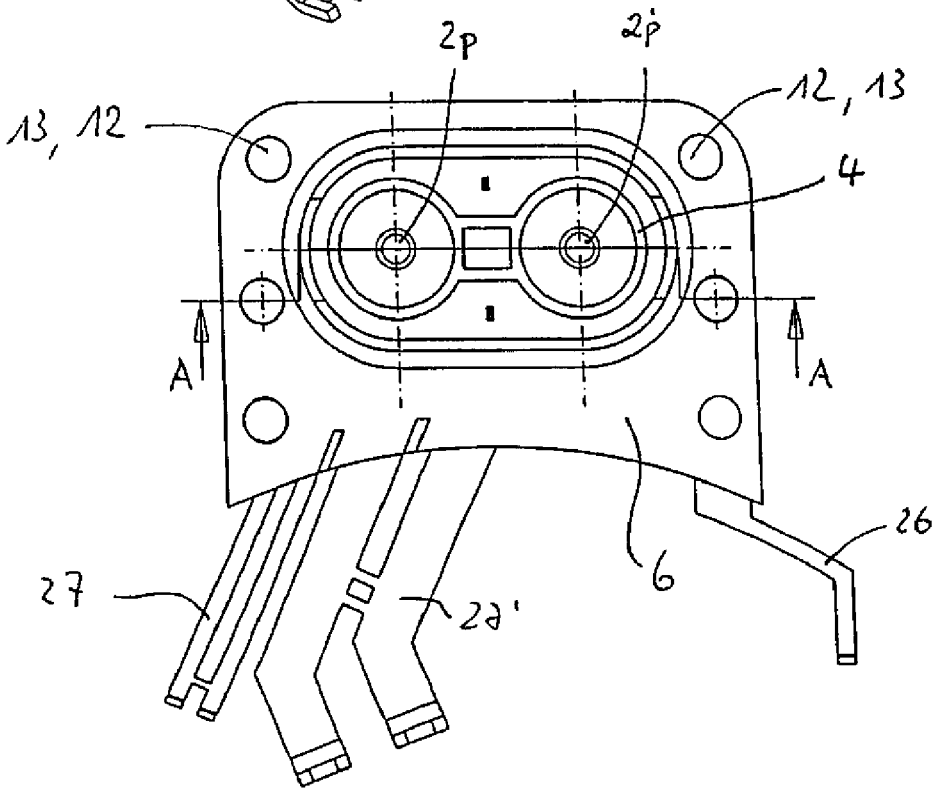
FIG. 2 shows a top view of the connection arrangement as claimed in the invention opposite the plug-in direction S and FIG. 3 shows a cutaway side view of the connection arrangement as claimed in the invention along cutting line A-A from FIG. 2.
Figure 3:
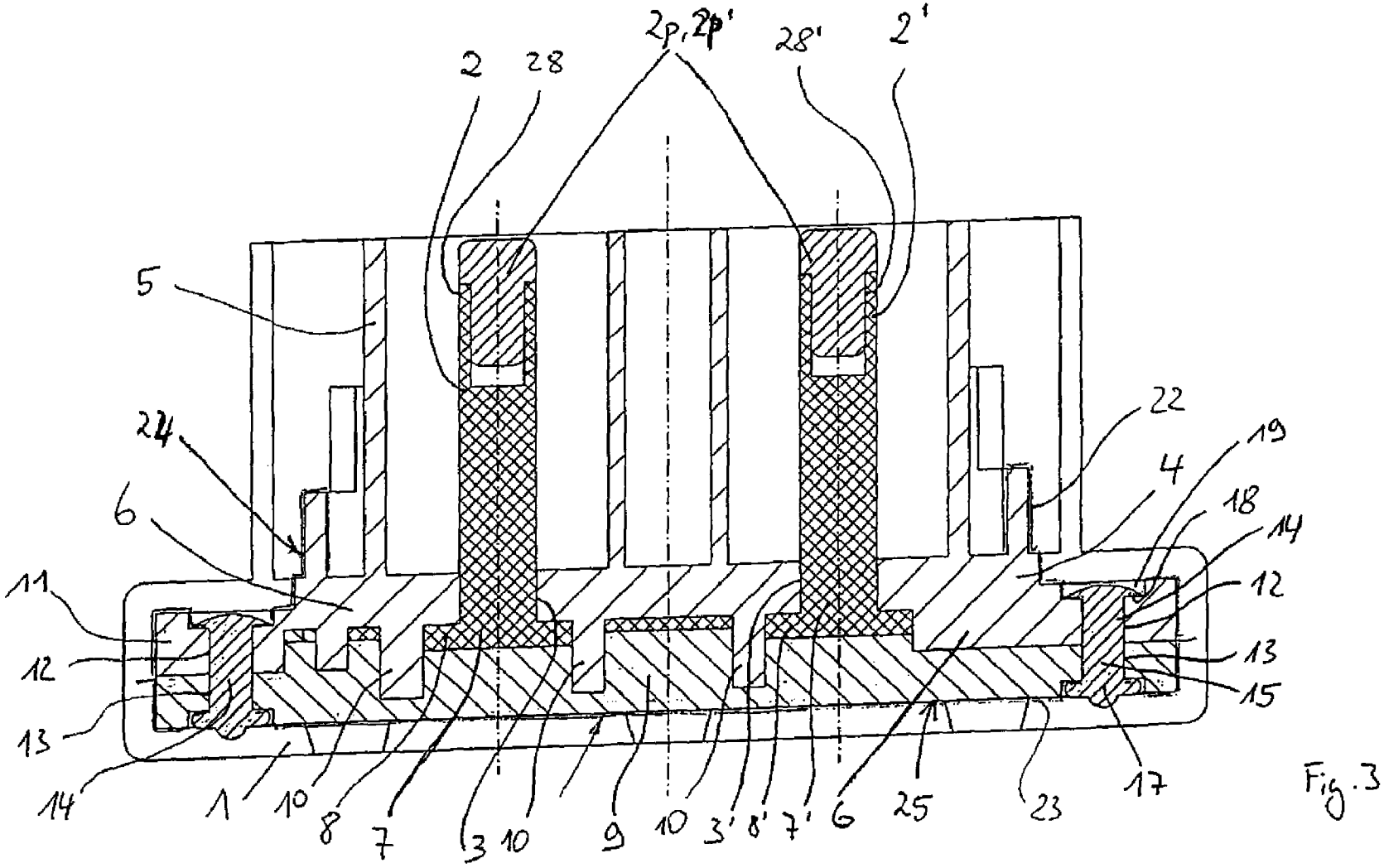

Two plug-in contacts 2, 2' are inserted into the corresponding through openings 3, 3' of a plug-in contour 4 which holds the plug-in contacts 2, 2'. The plug-in contour comprises a plug-in region 5 and a receiving region 6 for receiving and holding the plug-in contact 2, 2' in an attachment section 7, 7' of the plug-in contacts 2, 2'.

The attachment sections 7, 7' of the plug-in contacts 2, 2' are made T-shaped in cross section with one collar 8, 8' each which prevents the plug-in contacts 2, 2' from slipping through the through openings 3, 3'.

The plug-in contacts 2, 2' are attached by a cover 9 which is assembled positively with the receiving region 6, orientation ribs 10 preventing incorrect installation or incorrect alignment of the cover 9 to the receiving region 6.

The receiving region 6 has an essentially rectangular peripheral shoulder 11 whose outside dimensions essentially match the cover 9 so that the cover 9 and peripheral shoulder 11 in the region of their side edges end flush.

The plug-in contour 4 and the cover 9 are preferably made of plastic, while the plug-in contacts 2, 2' consist of an electrically conductive material. Electrically conductive connecting elements, specifically rivets 14, are guided through six rivet holes 12, 13 which are made both in the cover 9 and also in the peripheral shoulder 11. The cover 9 and peripheral shoulder 11 are attached by means of rivets 14, after routing each rivet shaft 15 of the rivets 14 through the rivet holes 12, 13 and after each swage-head 16 of the rivets 14 strikes a stop 18 of a depression 19 in the receiving region 6 each closing head 17 of the rivets 14 is molded onto a stop 21 in one recess 20 at a time.

By the attachment region 6 and the cover 9 being shielded in the region of their outside contours 24, 25 by shields 22, 23 and the shields 22, 23 being connected electrically conductively by the rivets 14 from the stop 18 to the stop 21, on the one hand an optimally conductive connection of the shields 22 and 23 is possible and on the other hand the rivets 14 at the same time ensure mechanical attachment of the plug-in contacts 2, 2' between the cover 9 and the receiving region 6.

The shielding 22 of the receiving region 6 extends into the plug-in region 5 of the plug-in contour 4 in order to be connectable to the shielding (not shown) of the mating connector (not shown).

The shields 22, 23 are routed out of the coating 1 which surrounds the aforementioned components by way of a shielding connection 26. Furthermore there are terminals 27, 27' for the plug-in contacts 2, 2'.

The shielding connection 26 and the terminals 27, 27' are made as flat conductors in order to ensure optimum shielding in the region of passage of the terminals 27, 27' and of the shielding connection 26 through the shields 22, 23.

The plug-in contacts 2, 2' each have caps 2*p*, 2*p'* which can be connected especially flush to the plug-in contacts 2, 2', which can be plugged into plug ends 28, 28' lying in the plug-in direction S, and which act as contact protection in the region of the plug-in opening of the connection arrangement. In spite of the especially mushroom-shaped, preferably non-conductive caps 2*p*, 2*p'*, the mating connector can make contact with the plug-in contacts 2, 2' by the mating connector's overlapping or surrounding the caps 2*p*, 2*p'*.

REFERENCE NUMBER LIST

1 coating
2, 2' plug-in contacts
2*p*, 2*p'* caps
3, 3' through openings
4 plug-in contour
5 plug-in region
6 receiving region
7, 7' attachment section
8, 8' collar
9 cover
10 orientation rib
11 peripheral shoulder
12 rivet holes
13 rivet holes
14 rivet
15 rivet shaft
16 swage-head
17 closing head
18 stop
19 depression
20 recess
21 stop
22 shielding
23 shielding
24 outside contour
25 outside contour
26 shielding connection
27, 27' terminals
28, 28' plug ends
S plug-in direction

The invention claimed is:

1. A shielded electrical connector comprising:

a plug-in contour that accommodates at least one plug-in contact and includes a plug-in region and a receiving region, the receiving region being configured to receive and hold the plug-in contact at an attachment section of the plug-in contact;

a cover for attaching the attachment section in the receiving region of the plug-in contour, the cover and the receiving region having shields on their outside surfaces; and electrically conductive connecting elements that provide an electrical connection between the shields and a mechanical connection between the cover and the plug-in contour.

2. The electrical connector of claim 1, wherein the shields are formed at least partially from an electrically conductive coating.

3. The electrical connector of claim 1, wherein the connecting elements are rivets.

4. The electrical connector of claim 1, wherein the connecting elements are countersunk into the outside surfaces of the cover and the receiving region such that their ends are substantially flush with the outside surfaces of the cover and the receiving region.

5. A shielded electrical connector comprising:

a plug-in contour that accommodates at least one plug-in contact and includes a plug-in region and a receiving region, the receiving region being configured to receive and hold the plug-in contact at an attachment section of the plug-in contact;

a cover for attaching the attachment section in the receiving region of the plug-in contour, the cover and the receiving region having shields on their outside surfaces; and electrically conductive connecting elements that provide an electrical connection between the shields and a mechanical connection between the cover and the plug-in contour, wherein the receiving region has a peripheral shoulder in which the connecting elements are located.

6. The electrical connector of claim 5, wherein the peripheral shoulder is located transversely to a plug-in direction.

7. The electrical connector of claim 1, wherein the electrical connector has an insulating coating.

8. The electrical connector of claim 1, wherein a shielding connection is electrically connected to the shields via contact with the connecting elements and/or via contact with the shields.

9. A process for producing a shielded connector comprising the steps of:

providing a plug-in contour that accommodates at least one plug-in contact and includes a plug-in region and a receiving region, the receiving region being configured to receive and hold the plug-in contact at an attachment section of the plug-in contact;

providing a cover for attaching the attachment section in the receiving region of the plug-in contour, the cover and the receiving region having shields on their outside surfaces; and providing electrically conductive connecting elements configured to provide an electrical connection between the shields and a mechanical connection between the cover and the plug-in contour;

accommodating the attachment section of the plug-in contact between the cover and the receiving region; and mechanically connecting the cover to the receiving region and electrically connecting the shields with the electrically conductive connecting elements.

* * * * *